United States Patent [19]

Oda et al.

[11] Patent Number: 4,615,964

[45] Date of Patent: Oct. 7, 1986

[54] VAPOR-DEPOSITED FILM OF SELENIUM AS PHOTORECEPTOR FOR ELECTROPHOTOGRAPHY AND PROCESS FOR PRODUCING THE SAME

[75] Inventors: Osamu Oda, Urawa; Arata Onozuka, Yono; Akio Koyama, Urawa, all of Japan

[73] Assignee: Nihon Kogyo Kabushiki Kaisha, Tokyo, Japan

[21] Appl. No.: 568,679

[22] Filed: Jan. 6, 1984

[30] Foreign Application Priority Data

Jan. 11, 1983 [JP] Japan ..... 58-1703
Nov. 10, 1983 [JP] Japan ..... 58-209978

[51] Int. Cl.[4] ..... G03G 5/082

[52] U.S. Cl. ..... 430/84; 430/95; 430/128

[58] Field of Search ..... 430/84, 128

[56] References Cited

U.S. PATENT DOCUMENTS 2,739,079 3/1956 Keck ..... 430/128 X
4,046,565 9/1977 Miller ..... 430/84 X
4,518,671 5/1985 Misumi et al. ..... 430/67 X

FOREIGN PATENT DOCUMENTS 54-9931 1/1979 Japan .
167030 10/1982 Japan .

OTHER PUBLICATIONS

Abdullaev et al., Phys. Stat. Sol., 18, K153 (1966).
Chemical Abstracts, 88/144781v; 94/113038e.
Shaffert, Electrophotography, Wiley (1975), pp. 297-299, 302, 303.

*Primary Examiner*—John D. Welsh
*Attorney, Agent, or Firm*—Seidel, Gonda, Goldhammer & Abbott

[57] ABSTRACT

A vapor-deposited film of selenium as a photoreceptor for electrophotography contains not more than 50 parts per million of oxygen. In producing the film, the oxygen content in the starting material selenium is controlled so that the resulting film contains oxygen within the specified range. The original oxygen content is reduced by vacuum distillation of the material selenium in a high vacuum, reduced-pressure distillation in high purity hydrogen, or preservation of the selenium shot in vacuo or in an inert gas. The starting material is obtained by mixing or melting selenium with a predetermined amount of selenium dioxide, or by carrying out vacuum distillation either of selenium at a vacuum degree of about $10^{-2}$ torr and thereby converting part of the material selenium into selenium dioxide, or of a mixture of selenium and a predetermined amount of selenium dioxide. The vacuum degree during the vapor deposition is controlled so that the oxygen content in the resulting film is 50 ppm or less.

3 Claims, 1 Drawing Figure

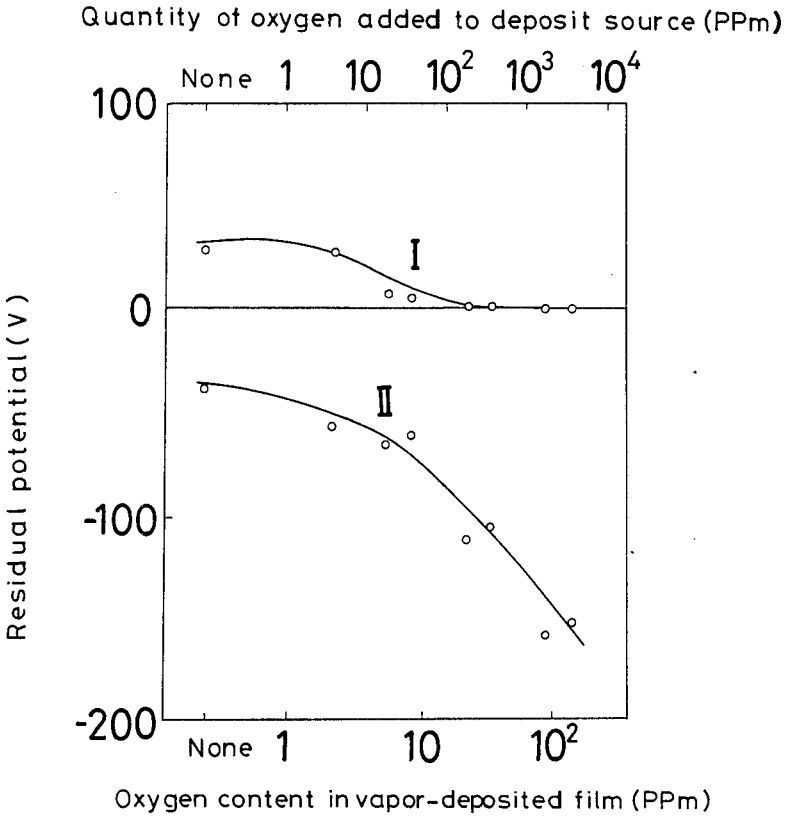
Quantity of oxygen added to deposit source (PPm)
None
1
10
$10^2$
$10^3$
$10^4$
100
0
-100
-200
I
II
Residual potential (V)
None
1
10
$10^2$
Oxygen content in vapor-deposited film (PPm)

VAPOR-DEPOSITED FILM OF SELENIUM AS PHOTORECEPTOR FOR ELECTROPHOTOGRAPHY AND PROCESS FOR PRODUCING THE SAME

BACKGROUND OF THE INVENTION

This invention relates to a vapor-deposited film of selenium as a photoreceptor for electrophotography and also to a process for producing the same, characterized in that the oxygen content in the film is controlled to be not more than 50 parts per million.

Electrophotography is a photocopying process which utilizes the photoconductivity and electrostatic behavior of certain substances. Of some methods so far established, one known as the Xerox process, or xerography, involves the use of a vapor-deposited film of selenium as a photoreceptor and the transfer of image for printing as an electronic photograph. The process comprises the steps of (a) charging, in which the surface of a photosensitive plate, consisting of an amorphous selenium layer with a high dark resistance vapor-deposited on a metal substrate, is electrostatically charged;

(b) exposure (printing), in which, upon exposure to an optical image, the areas of selenium irradiated with the light undergo a decrease in the electric resistance, the electrostatic charge escapes from the surface to the metal substrate, and the residual charge density on the photosensitive plate varies according to the amounts of exposure, thus forming an electrostatic latent image of the same pattern as the original copy on the selenium surface;

(c) development, in which a mixed powder of a toner, consisting of fine resin-coated carbon particles, and a carrier, consisting of microspheroidal glass, is dusted over the photosensitive plate surface, so that the toner adheres to the latent image and makes it visible;

(d) transfer, in which a sheet of appropriate paper is placed over the developed photosensitive plate surface, and the back of the paper is charged by the use of a corona discharge, whereby the toner on the photosensitive plate is attracted to the paper and the toner powder image is transferred onto the paper; and (e) fixing, in which the paper onto which the image has been transferred is removed from the photosensitive plate surface and is heated by an infrared heater to fuse and deposit the toner resin permanently onto the paper.

Through a sequence of these steps a reproduced image (electronic photograph) of the original is obtained. Clearness of the copied image, or the reproducibility of the original, is largely dependent on the performance of selenium as the photoreceptor. For the evaluation of the photoreceptor performance, apparently useful measures include: (i) the corona charge characteristic which represents the electrostatic charge produced by a corona discharge of a given output; (ii) the dark decay characteristic related to the loss of charge while the photoreceptor, charged by the corona discharge, is held in the dark; (iii) charged potential decrease characteristic on exposure which represents the rate at which the charge held in darkened conditions disappears upon exposure; and (iv) residual potential which represents the potential that remains, instead of reduction to naught, after the exposure of the photoreceptor. Of these factors, the residual potential plays the most important role in stabilizing the contrast and quality of the electrophotograph and the properties of the selenium photoreceptor. In principle, the residual potential, where present, makes the contrast of the resulting electrophotograph indistinct by a so-called "ghost image" phenomenon.

As regards the residual potential, a major subject of consideration in the art has been the residual potential in the positively charged photoreceptor film, and varied attempts have been made to reduce it to zero or a minimum. For example, a known practice consists in doping a vapor-deposited film of selenium with a trace amount of a halogen, such as fluorine, chlorine, or bromine. The halogen-containing selenium film thus obtained does reduce the residual potential upon exposure to zero or a minimum. However, it undergoes such serious dark decay of the surface charge in the course of latent image formation that the functions of the resulting photosensitive plate are badly affected.

Recently, copying systems which utilize compatible positive and negative chargings have attracted attention. In this case it is ideal that the residual potentials in the positively and negatively charged film be both reduced to naught or minimized. However, the realization of the ideal is expected to involve no small difficulties. If the residual potentials upon the positive and negative charging are balanced within a not too broad range, the photoreceptor selenium film would serve satisfactorily for the copying system that depends on both positive and negative charges. For this application it is important that the photosensitive plate should not undergo serious functional deterioration, for example, worsened dark decay as is the case with the halogen doping.

In the positive-charge copying system, it is said that, even though the residual potential in the positively charged photoreceptor is reduced to a minimum or zero, a too high residual potential at the time of negative charging would have an adverse effect upon the photosensitive plate performance.

SUMMARY OF THE INVENTION

It is an object of the present invention to provide a vapor-deposited film of selenium as a photoreceptor for electrophotography, or for the copying system which uses positive charging, the film being able to reduce the positive-charge residual potential to zero or a minimum within the range in which the negative-charge residual potential is not too high, with only limited dark decay, and also to provide a process for producing such a film.

Another object of the invention is to provide a vapor-deposited selenium film with relatively low residual potentials when charged both positively and negatively, the both potentials being well balanced, and with stabilized characteristics, as a photoreceptor for a copying system using both positive and negative charges.

Despite a general presumption that the oxygen content in the vapor-deposited selenium film would have some influence upon the film performance, practically no close investigation has so far been made as to the effect of a trace amount of oxygen upon the electrophotographic characteristics of the selenium film.

We have studied for long about the correlationship between the oxygen content in the vapor-deposited selenium film and the residual potentials at the time of positive and negative charging. As a result, it has now been found that a vapor-deposited selenium film that realizes the objects of the invention is obtained by controlling the oxygen content in selenium within the range of 50 parts per million.

Controlling the oxygen content to be in the range of 10 to 50 ppm permits reduction of the residual potential at the time of positive charging close to zero and restriction of that at the time of negative charging to an allowable level, thus enabling the selenium photoreceptor to be useful for the positively charged system.

If the oxygen content in selenium is decreased to 10 ppm, the residual potentials in the positively and negatively charged film are relatively low and well balanced, and therefore the selenium photoreceptor is suited for the positive-negative charging system.

In the amorphous state, selenium contains numerous neutral dangling bonds, some of which are polarized positively and negatively. These polarized dangling bonds are considered to form deep energy levels which serve as electron and hole traps. The existence of a small amount of oxygen will affect on the trap densities so that it is quite important to control the oxygen content in selenium. Reducing the oxygen content to 50 ppm or less has been found contributory to change these trap densities and accordingly to a greater stability of the selenium properties, for example the residual potential. On a copying machine the selenium photoreceptor is used under varied charging and exposure conditions. A higher residual potential in the positively charged photoreceptor has a possibility to cause deterioration of its characteristics under certain service conditions. The reduction of the oxygen content to the range of 50 ppm or less is beneficial in that it enables the selenium photoreceptor to be used under varied conditions without any deterioration of its characteristics.

Thus, the invention provides a vapor-deposited film of selenium as a photoreceptor for electrophotography, which consists of pure selenium in which the oxygen content is controlled to be within the range of 50 ppm depending on the intended use. Also, the invention provides a process for producing such a photoreceptor characterized in that the oxygen content in the deposited selenium film is kept to be not more than 50 ppm either by controlling the oxygen content in the starting material selenium so that the deposited film may contain not more than 50 ppm oxygen and then effecting the vacuum deposition or by controlling the degree of vacuum during the course of evaporation.

BRIEF DESCRIPTION OF THE DRAWING

The single FIGURE is a graph showing the relation between the oxygen content in the oxygen-containing, vapor-deposited film of selenium according to the invention and the photoelectric characteristic (residual potential) of the film.

DETAILED DESCRIPTION

The present invention will be described in more detail below.

Selenium as a photoreceptor for copying equipment can be severely affected by the presence of trace amounts of certain impurities. For example, it is reported (in Japanese Patent Application Public Disclosure No. 67752/1980) that the Fe content should be kept below 2 ppm because if it exceeds the limit, cumulative build-up of the residual potential would cause ghost images. Effects of various other impurities are also under study. Our investigations about the electrophotographic properties of selenium, especially about the influence of oxygen upon the residual potential, have revealed the facts graphically represented in the accompanying drawing. (The experimental details will be given later in Examples.) It will be seen from the graph that, as the oxygen content increases, the residual potential in the positi-vely charged film decreases, whereas the residual potential at the time of negative charging increases materially. This is attributable to the phenomena that may be explained as follows. Selenium in the amorphous form contains numerous neutral dangling bonds ($D^o$). These bonds are thermodynamically stable when partly polarized, and therefore they undergo polarization in conformity with the formula $D^o = D^+ + D^-$ in which $D^+$ and $D^-$ are, respectively, positively and negatively charged dangling bonds acting as traps for electrons and holes. In pure selenium the numbers of $D^+$ and $D^-$ are equal under the neutral condition $[D^+]=[D^-]$. However, in the presence of an impurity, such as oxygen, with a high electronegativity, the neutral condition changes to $[D^+]=[D^-]+[O^-]$, and the number of $D^+$ increases while that of $D^-$ decreases. It is thus possible to change the concentrations of the inherent defective structures $D^+$, $D^-$ and thereby control the characteristics of the resulting photoreceptor.

As the oxygen content increases from zero upward, the residual potential in the photoreceptor on positive charging declines. With oxygen in excess of 10 ppm the potential is between a minimum and zero, whereas the residual potential upon negative charging increases, the rate of increase becoming unallowable at over 50 ppm. Where the negative-charge residual potential is so high, the charging system, to say nothing of the positive-negative charging system, can instabilize the film characteristics under certain charging and exposure conditions.

When the oxygen content is in the range of 10 to 50 ppm, the positive-charge residual potential is at a minimum or zero and the negative-charge residual potential is in a permissible range. This is desirable for the positive charging system.

With an oxygen content of less than 10 ppm the film maintains a relatively good balance between the positive- and negative-charge residual potentials and, moreover, the both potentials are kept at fairly low levels. These conditions are favorable for the positive-negative charging system.

According to this invention, before vacuum-depositing selenium on a substrate surface, the oxygen content in the selenium as the material to be evaporated in the vacuum can be reduced to a minimum, for example, by (1) vacuum distillation of selenium in a high vacuum, (2) reduced-pressure distillation in high purity hydrogen, or (3) preservation of the selenium shot in a vacuum or an inert gas. The methods (1) and (2) produce selenium with extra-low oxygen contents which upon FT-IR analyses indicate no peak of oxygen (at 904 $cm^{-1}$) A selenium photoreceptor containing a very low level of oxygen can be made directly from such a selenium or by adding thereto some oxygen through the control of the atmosphere during the process of vacuum deposition.

When an oxygen content from several to 50 ppm is desired, the oxygen may be added to selenium by any of the following methods:

(1) Prior to vacuum evaporation, selenium as the deposit source is mixed with a predetermined amount of selenium dioxide, and then the mixture is deposited on the substrate in a vacuum.

(2) Oxygen is added to material selenium by melting the latter together with a predetermined amount of selenium dioxide by the application of heat in vacuo.

(3) During vacuum distillation, which is a process for purifying material selenium, oxygen gas is introduced into the material at a vacuum degree of about $10^{-2}$ torr so that part of the material is converted to selenium dioxide. The selenium to which oxygen has been added in this way is used as the material for vacuum deposition.

(4) During vacuum distillation for material purification, the selenium as a source of deposit is premixed with a predetermined amount of selenium dioxide, and then the mixture is vacuum-distilled to obtain an oxygen-doped selenium for use in vacuum deposition.

(5) The degree of vacuum during vacuum deposition is set lower than the usual level of $10^{-5}$ to $10^{-6}$ torr, so that the deposition forms a film containing a predetermined proportion of oxygen.

When the deposit-source selenium for forming a vapor-deposited film of selenium as a photoreceptor in accordance with the invention is to be prepared by adding oxygen in the form of selenium dioxide to the material selenium, it is necessary to add more oxygen than is to be contained in the deposited film. This is because not the whole amount but only part of oxygen from the deposit-source selenium is transferred to the resulting film.

The relationship between the amount of oxygen added to the source of deposit and the oxygen content in the deposited film of selenium will be understood from the respective data plotted as abscissa in the graph.

The conditions for vapor deposition of the deposit-source selenium are not critical; conventionally employed conditions will serve the purposes of the invention.

For example, the substrate to carry the vapor-deposited film of selenium may be aluminum, copper, or other metal, metallized paper or plastics, or the like.

The deposit-source temperature may be suitably chosen from the range of 250° to 350° C.; the substrate temperature, from 55° to 70° C.; the degree of vacuum, from $10^{-5}$ to $10^{-6}$ torr; and the deposition time, from 60 to 120 minutes.

In order to allow the vapor-deposited selenium film to contain oxygen through the evaporation process, it is only necessary to operate the process while maintaining a lower vacuum level than when oxygen is not added.

The invention is illustrated by the following examples.

EXAMPLE 1

A selenium having a purity of 6N (99.9999% pure) with the impurities shown in Table 1 was mixed, in divided portions, with varied proportions of a 4N-pure selenium dioxide so that seven test specimens with oxygen contents of 3.5, 17.5, 35, 175, 350, 1740, and 3500 ppm were prepared.

TABLE 1

| Impurity: | Te | Sb | Cu | Pb | Zn | Fe | Ni | Hg | O |
|---|---|---|---|---|---|---|---|---|---|
| Content: (ppm) | <0.01 | <0.01 | <0.01 | <0.01 | <0.03 | <0.05 | <0.01 | <0.05 | <2 |

These test mixtures were vapor-deposited by resistance heating on 55 mm-square mirror-finished pieces of aluminum substrate.

The conditions used for the vapor deposition were as below:

| | |
|---|---|
| Deposit-source temperature = | 270° C. |
| Substrate temperature = | 60° C. |
| Degree of vacuum = | $2 \times 10^{-6}$ torr |
| Deposition time = | 60 min. |

The selenium films thus formed on the aluminum substrates were about 50 μm thick.

The oxygen contents in the vapor-deposited selenium films were determined with an infrared spectroscopic analyzer to be 2, 5, 10, 20, 45, 80, and 135 ppm correspondingly to the original contents in the seven test specimens.

By means of an electrostatic testing instrument the seven different selenium films were tested for their photoelectric characteristic (residual potential) values under the following conditions:

| | |
|---|---|
| Corona discharge voltage = | 5 kV. |
| Dark decay time = | 2 sec. |
| Illuminance & time for exposure = | 20 1×, 60 sec. |
| Illuminace & time for destaticization = | 20000 1×, 2 sec. |
| No. of cycles = | 50 |

The results are plotted in the graph in terms of the relation between the residual potentials and the oxygen contents in the vapor-deposited films. In the graph, the curve I indicates the residual potential at the time of positive charging and the curve II, the potential at the time of negative charging. As already explained, an oxygen content of less than 10 ppm permits the photoreceptor to keep the negative-charge residual potential relatively low and well balanced with the positive-charge residual potential. With an oxygen content in excess of 10 ppm, however, the positive-charge residual potential decreases to a minimum or zero while the negative-charge residual potential increases considerably. If the oxygen content exceeds 50 ppm, it is obvious that the negative-discharge residual potential increases to an impermissible level.

EXAMPLE 2

Vapor-deposited films of selenium, allowed to contain different proportions of chlorine in the same way as with the addition of oxygen were tested for their dark decay rates. The results are compared with those of the oxygen-containing films in Table 2.

The term "dark decay rate" as used herein means the value represented by $(V_0-V_{60})/V_0$, in which $V_0$ is the surface potential of the vapor-deposited film upon charging by the use of a corona discharge and $V_{60}$ is the surface potential after 60 seconds of dark decay that followed the charging.

TABLE 2

| O-contg-vapor-depstd Se film | | | Cl-contg vapor-depstd Se film | |
|---|---|---|---|---|
| Qty of O added (ppm) | O content (ppm) | Dark decay rate | Qty of Cl added (ppm) | Dark decay rate |
| Not added | | 0.36 | Not added | 0.36 |
| 3.5 | 2 | 0.13 | 0.1 | 0.54 |
| 17 | 5 | 0.15 | 1 | 0.81 |

TABLE 2-continued

| O-contg-vapor-depstd Se film | | | Cl-contg vapor-depstd Se film | |
|---|---|---|---|---|
| Qty of O added (ppm) | O content (ppm) | Dark decay rate | Qty of Cl added (ppm) | Dark decay rate |
| 35 | 10 | 0.22 | 10 | 0.98 |
| 175 | 20 | 0.16 | 100 | 0.99 |
| 350 | 45 | 0.15 | — | — |
| 1750 | 80 | 0.22 | — | — |
| 3500 | 135 | 0.29 | — | — |

It will be clearly understood from Table 2 that the dark decay rates of the oxygen-containing, vapor-deposited selenium films are extremely low as compared with the rates of the conventional chlorine-containing films.

As has been described hereinbefore, the selenium photoreceptor according to this invention, allowed to contain oxygen in a controlled amount of not more than 50 ppm depending on the intended use, exhibits an excellent residual potential characteristic. With a low rate of dark decay the selenium as a photoreceptor has sufficiently stabilized properties to meet the requirements of the users.

What is claimed is:

1. A vapor-deposited film of selenium as a photoreceptor for electrophotgraphy characterized by an oxygen content of not more than 10 ppm whereby a well balanced positive- and negative-residual potentials of the selenium photreceptor is obtained.

2. The vapor-deposited film of selenium according to claim 1 wherein the film is produced by vacuum vapor deposition.

3. The vapor-deposited film of selenium according to claim 1 wherein the selenium has a 6N purity.

* * * * *